United States Patent [19]

Dezelan

[11] 4,019,585

[45] Apr. 26, 1977

[54] COMBINED AUTOMATIC AND MANUAL HYDRAULIC CONTROL FOR MOTOR GRADER BLADE

[75] Inventor: Joseph Edward Dezelan, Joliet, Ill.

[73] Assignee: Caterpillar Tractor Co., Peoria, Ill.

[22] Filed: Mar. 17, 1976

[21] Appl. No.: 667,737

Related U.S. Application Data

[63] Continuation of Ser. No. 427,791, Dec. 26, 1973, abandoned.

[52] U.S. Cl. ..... 172/4.5; 91/20; 91/445

[51] Int. Cl.[2] ..... E02F 3/76; F01B 25/02; F01B 25/04

[58] Field of Search ..... 91/6, 20, 30, 363 A, 91/427, 445, 448; 172/4.5; 37/DIG. 20

[56] References Cited

UNITED STATES PATENTS

| | | | |
|---|---|---|---|
| 2,940,428 | 6/1960 | Brandstadter | 91/448 X |
| 2,944,524 | 7/1960 | Brandstadter et al. | 91/445 X |
| 3,229,391 | 1/1966 | Breitbarth et al. | 172/4.5 |
| 3,411,411 | 11/1968 | Fleck et al. | 91/30 |
| 3,747,351 | 7/1973 | Wilkerson et al. | 91/420 |
| 3,813,990 | 6/1974 | Coppola et al. | 91/363 A |

*Primary Examiner*—Irwin C. Cohen
*Attorney, Agent, or Firm*—Phillips, Moore, Weissenberger, Lempio & Majestic

[57] ABSTRACT

There is disclosed a hydraulic control system including body automatic and manual control for controlling the position of a grader blade for a motor grader. The hydraulic system is supplied fluid from a single pump and is provided with means to isolate the fluid supply from the automatic portion of the system when the manual portion of the system is activated.

6 Claims, 1 Drawing Figure

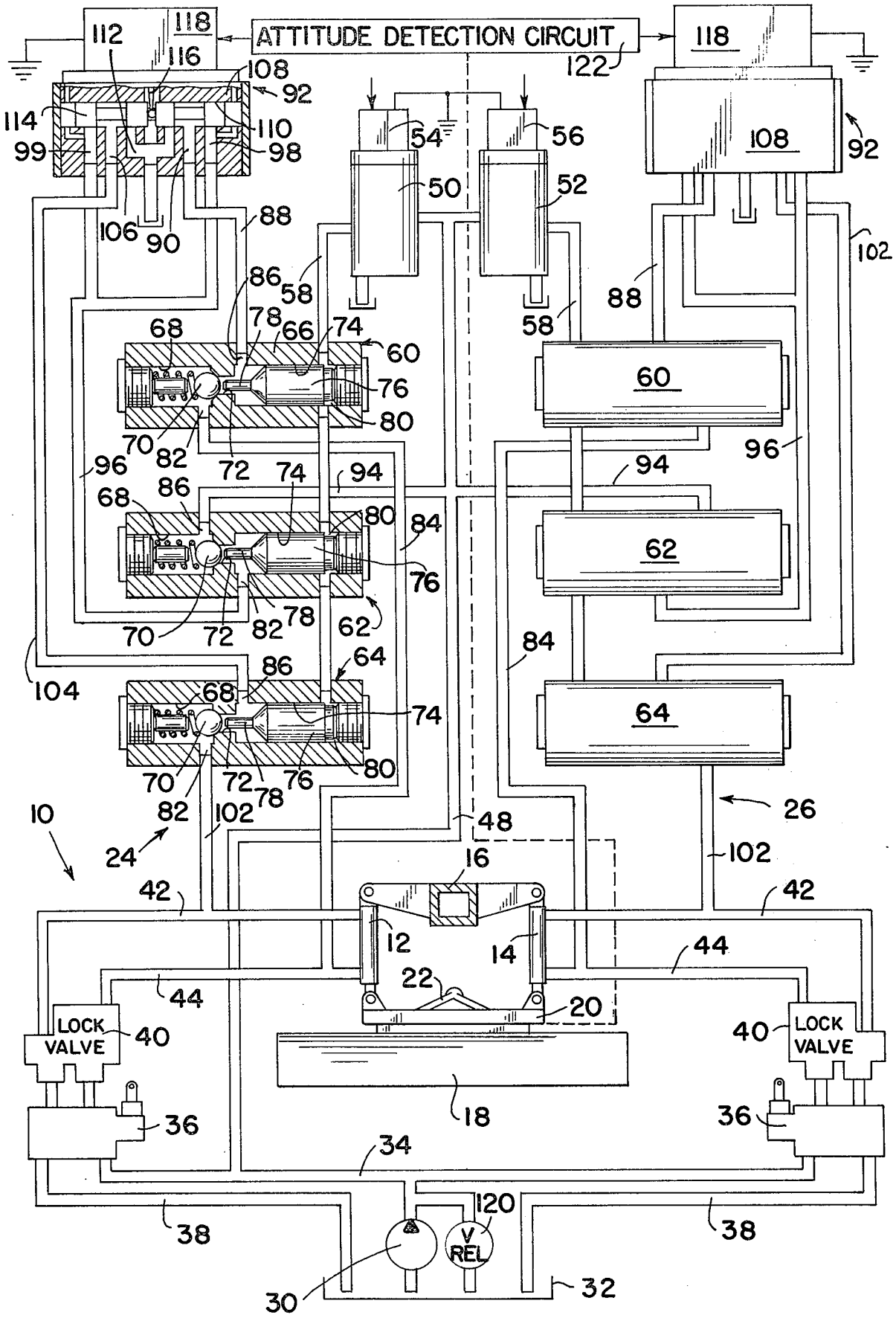
ATTITUDE DETECTION CIRCUIT
LOCK VALVE
LOCK VALVE
V REL

COMBINED AUTOMATIC AND MANUAL HYDRAULIC CONTROL FOR MOTOR GRADER BLADE

This is a continuation of Ser. No. 427,791, filed Dec. 26, 1973, and now abandoned.

BACKGROUND OF THE INVENTION

The present invention relates to a hydraulic control system and pertains particularly to combined automatic and manual hydraulic control means for a motor grader blade which provides sensitive precise control of the blade position during the automatic mode of operation, with provision to isolate the automatic portion of the system when in the manual mode of operation to reduce leakage and provide a more efficient control circuit.

Hydraulic control circuits for motor grader blades having both manual and automatic modes of operation are presently known as exemplified by Breitbarth et al. U.S. Pat. No. 3,229,391, and Page et al. U.S. Pat. No. 3,486,564 both of common assignment herewith. In these systems, as is best shown in the Breitbarth et al. patent, a pair of electrohydraulic valves are connected to the blade lift cylinders in parallel with a pair of manual control valves for either manual or automatic control of the blade position. When the automatic mode of operation is initiated by the operator, an electric machine attitude sensing mechanism controls the electrohydraulic valve to provide precise adjustment of the blade relative to the vehicle to maintain a level cut, grade, or slope (with one side actuated) at all times. The manual blade lift control valves are under operator control for manually positioning the blade during periods of operation when the automatic blade control is inactive. With these systems, the pump supply line and the motor lines are in constant communication with the very sensitive automatic blade control valve spool even during the manual mode of operation. In order to achieve precise control by instantaneous movement of the blade as the result of minute movement of the automatic control valve spool, leakage rate through such spool is extremely high, thus detrimentally affecting the efficiency of the manual mode of operation of the blade lift circuit. As a result, in order to achieve satisfactory speed of blade movement during the manual mode of operation, it is sometimes necessary to provide an oversize pump to compensate for the excess leakage through the automatic control valve. Another problem associated with such a system is drift of the implement caused by cylinder holding fluid leakage across the automatic blade control valve spool when in the manual mode of operation, requiring frequent correction by the operator.

SUMMARY AND OBJECT OF THE INVENTION

It is therefore a primary object of the invention to provide a combined automatic and manual control system with means to overcome the above problems of the prior art.

Another object of the present invention is to provide a combined automatic and manual control system with means to isolate the automatic control valve from the manual blade control system when the automatic control system is inactive.

BRIEF DESCRIPTION OF THE DRAWING

The FIGURE is a schematic layout of a preferred embodiment of the present invention.

DETAILED DESCRIPTION OF THE PREFERRED EMBODIMENT

With reference now to the drawing, there is illustrated a motor grader control circuit generally designated by the reference numeral 10 operatively connected for control of a pair of blade lift cylinders 12 and 14 interposed between a motor grader frame 16 and a motor grader blade 18. The blade is supported from the motor grader frame in the usual manner such as by a circle mechanism 20 and a longitudinal stabilizer link 22. The circuit 10 includes a pair of control circuits 24 and 26 individually operatively connected with a respective one of the jacks 12 and 14 to permit independent control of the jacks for tilting of the motor grader blade, as well as simultaneous control for raising and lowering the total blade.

Since the two circuits 24 and 26 are identical, the control circuit 24 for the jack 12 will be described in detail with corresponding numbers applied to identical elements in the circuit 26 for the jack 14.

A pump 30 is operative to draw fluid from a tank or sump 32 for supplying pressurized fluid through a line 34 to a manual control valve 36 which is also in communication with the tank by way of a return line 38. The construction of valve 36 is preferably such as disclosed in application Ser. No. 212,184 filed Dec. 12, 1971, by H. L. Johnson, entitled "All Hydraulic Motor Grader Circuitry" and assigned to the assignee hereof. The valve 36 is further communicated with the opposite ends of jack 12 by way of a lock valve 40 preferably as shown in Ser. No. 355,473 filed Apr. 30, 1973, by H. L. Johnson, entitled "Lock Valve" of common assignment herewith and a pair of motor lines 42 and 44. With this arrangement the operator has complete control of the blade such that movement of the valve 36 in one direction is effective to communicate fluid to the head end of the jack by way of line 42 for lowering that end of the blade. Movement of the valve in the opposite direction communicates fluid under pressure through the line 44 to the rod end of the jack 12 to raise the blade 18.

The pressure supply line 34 also communicates by way of a branch line 48 to a pair of solenoid pilot valves 50 and 52 which are controlled by a pair of solenoids 54 and 56, respectively. The valve 50 communicates by way of a line 58 with a plurality of pilot operated check valves 60, 62 and 64. The pilot operated check valves are identical in construction and each individually include a body 66 having a bore 68 adjacent one end thereof for housing a spring biased ball check 70 which normally blocks a small passage 72 communicating between the bore 68 having a port 82 communicating therewith and a slightly larger diameter bore 74 having a port 86 communicating therewith. The ball 70 in each valve controls communication between ports 82 and 86. A piston 76 is reciprocably disposed in the bore 74 and includes an actuating extension 78 which is adapted for selective engagement with the ball check 70. The piston 76 defines with the bore 74 a pressure chamber 80 which is in open communication to the line 58.

In the illustrated circuit, a port 82 of the specific pilot valve 60 communicates by way of a line 84 between the bore 68 and the rod end of the jack 12. A port 86 of valve 60 communicates by way of a line 88 between the bore 74 and a motor port 90 of an electrohydraulic valve 92.

In the pilot actuated check valve 62, the port 86 communicates by way of a line 94 with the branch line 48 to supply fluid pressure to the bore 68 on the upstream side of the ball check valve 70. Port 86 of that pilot operated check valve communicates by way of a line 96 between the bore 74 and a pair of inlet ports 98 and 99 of the electrohydraulic valve 92.

In the pilot operated check valve 64, the port 70 communicates by way of a line 102 between the bore 68 and the motor line 42 communicating to the head end of jack 12. The port 86 of the check valve 64 communicates by way of a line 104 between the bore 74 and a motor port 106 of the electrohydraulic valve 92.

The electrohydraulic valve 92 includes a body 108 having a longitudinal bore 110 extending therethrough which communicates with the inlet ports 98 and 99 and the motor ports 90 and 106, as well as a branched return passage 112. A spool 114 is reciprocably disposed in the bore 110 with its position being controlled in response to the position of a wand 116 which is activated by a suitable control means such as a torque motor 118.

In order to achieve precise positioning of the blade due to slight variations in machine attitude it is necessary to minimize deadband in the electrohydraulic valve 92; i.e., movement of the spool necessary to permit flow. Since seal length along the spool to control leakage is directly related to spool overlap or deadband the demand for extra sensitive control detrimentally affects such leakage control.

In operation, with the system conditioned for manual mode of operation, that is no electrical signal to the solenoids 54 and 56, the pressure chambers 80 of the pilot operated check valves 60, 62 and 64 will be communicated to tank by the valve 50 such that the ball check 70 will be closed to block communication between bores 68 and 74. Under these conditions, the check valve 62 is effective to block communication between the pump output line 34 and the electrohydraulic valve 92 by way of lines 48 and 94 so that the fluid output of the pump is supplied only to the manual valves 36, with the pressure in the system limited to a safe predetermined value by a suitable relief valve 120. Under these conditions, manipulation of either of the manual control valves 36 is effective to control the elevational position as well as the angular attitude of the blade 18 by individual or simultaneous actuation of the jacks 12 and 14.

When the operator conditions the system for an automatic mode of operation, an electrical switch will be closed to energize the solenoids 54 and 56 and thus position the valves 50 and 52 to communicate the fluid pressure output of the pump 30 to the chambers 80 of the pilot operated check valves 60, 62 and 64 by way of the lines 58. The pressure in the chambers 80 moves the pistons 76 leftward as viewed in the drawing so that the actuating extensions 78 engage the ball checks 70 to urge them to an open position providing communication between the bores 68 and 74 by way of the passage 72. This conditioning is effective to communicate the output pump 30 by way of lines 34, line 48, line 94, port 86, passage 72, port 82, and line 96 to the inlet ports 98 and 99 of the electrohydraulic valve 92. With the ball checks 70 of the pilot operated check valves 60 and 64 in the open position, the motor ports 90 and 106 are respectively communicated with the motor lines 42 and 44 so as to permit unrestricted flow between the electrohydraulic valve 92 and the motor 12.

A machine attitude detection circuit, indicated generally at 122, is connected to the torque motor 118 and is effective to direct error signals to those torque motors as a result of a change in machine attitude to activate the control means for shifting the spool 114 in the appropriate direction to communicate the appropriate one of the inlet ports 98 and 99 with its respective associated motor port 90 or 106. For example, should the left side of the vehicle tilt downward with respect to a predetermined grade reference, the torque motor 118 acting through the control means will shift the spool 114 to the right to communicate inlet port 98 with the motor port 90 and thus direct the fluid pressure output of pump 30 to the line 44 and thus the rod end of jack 12 to raise that end of the blade to maintain the desired grade reference. Tilting of the left side of the machine upward will shift the spool 114 to the left to pressurize the motor line 42 in the head end of the jack 12 to lower that end of the blade and thus maintain the precise desired angularity of the blade with respect to the grade reference.

The circuit 26 functions in identical manner to control the positioning of jack 14 and in cooperation with the circuit 24 maintains the elevational position and angular attitude to the blade 18 in a precise desired relationship to a grade reference under all operating conditions.

The attitude detection circuit may be of any suitable construction such as that shown in U.S. Pat. Nos. 3,299,391; 3,486,564; and 3,495,663 all of common assignment herewith.

While the invention has been illustrated and described with reference to a single disclosed embodiment, it is apparent that numerous changes and modifications may be made in the illustrated embodiment without departing from the spirit and scope of the invention as defined in the appended claims.

What is claimed is:

1. A control system for controlling the position of a work implement comprising:

a hydraulic motor for positioning a work member;

a source of pressurized fluid for powering said hydraulic motor;

a manual control valve in continuous uninterrupted communication with said source for directing fluid from said source for operation of said motor;

lock valve means disposed between said manual control valve and said motor for locking said motor in a selected position when said manual control valve is in a neutral position;

attitude detection means for detecting deviations in a predetermined attitude of said work member and generating a signal in response to any such change;

attitude responsive valve means connected in parallel with said manual control valve between said source and said hydraulic motor and responsive to said signal for controlling communication of fluid to said motor for thereby making corrections in the attitude of said work member;

first pilot fluid operated check valve means for normally blocking flow of fluid from said source to said attitude responsive valve means;

second pilot operated check valve means for normally blocking flow of fluid from said motor to said attitude responsive valve means; and, pilot control valve means connected to said source for simultaneously providing fluid for opening said first and said second pilot operated check valve means for providing open communication of said source to said attitude responsive valve means and for providing open communication of said attitude responsive valve means with said hydraulic motor.

2. The hydraulic system of claim 1 wherein each of said check valve means includes a spring biased ball member for blocking said flow of fluid; and, fluid operated plunger means for unseating said ball member.

3. The hydraulic system of claim 2 wherein said pilot control valve means includes a solenoid operated valve for directing pressurized fluid from said source for operation of said plunger of each of said check valves.

4. A combined automatic and manual control system for a motor grader for controlling the angle and vertical position of a grader blade comprising:

a frame member;

a grader blade supported by said frame member for movement relative thereto;

a hydraulic motor for positioning said blade;

a source of pressurized fluid for powering said hydraulic motor;

a manual control valve in continuous uninterrupted communication with said source for directing fluid from said source for operation of said motors;

lock valve means disposed between said manual control valve and said motor for locking said motor in a selected position when said manual control valve is in a neutral position;

attitude detection means for detecting deviations in a predetermined attitude of said blade and generating a signal in response to any such change;

attitude responsive valve means connected in parallel with said manual control valve between said source and said hydraulic motor and responsive to said signal for controlling communication of fluid to said motor for thereby making corrections in the attitude of said work member;

first pilot fluid operated check valve means for normally blocking flow of fluid from said source to said attitude responsive valve means;

second pilot operated check valve means for normally blocking communication of fluid from said motor to said attitude responsive valve means; and, pilot control valve means connected to said source for simultaneously providing fluid for opening said first and said second pilot operated check valve means for providing open communication of said source to said attitude responsive valve means and for providing open communication of said attitude responsive valve means with said hydraulic motor.

5. The hydraulic system of claim 4 wherein each of said check valve means includes a spring biased ball member for blocking said communication; and, fluid operated plunger means for unseating said ball member.

6. The hydraulic system of claim 5 wherein said pilot control valve means includes a solenoid operated valve for directing pressurized fluid from said source for operation of said plunger of each of said check valves.

* * * * *